US007416085B2

(12) United States Patent
Kadel

(10) Patent No.: US 7,416,085 B2
(45) Date of Patent: Aug. 26, 2008

(54) SIEVING DEVICE HAVING BEATING ELEMENTS

(75) Inventor: Rolf Kadel, Weinheim (DE)

(73) Assignee: Ludwig Krieger Draht- und Kunststofferzeugnisse GmbH, Karlsruhe-Hagsfeld (DE)

( * ) Notice: Subject to any disclaimer, the term of this patent is extended or adjusted under 35 U.S.C. 154(b) by 470 days.

(21) Appl. No.: 10/525,280

(22) PCT Filed: Jun. 26, 2003

(86) PCT No.: PCT/EP03/06780

§ 371 (c)(1),
(2), (4) Date: Feb. 18, 2005

(87) PCT Pub. No.: WO2004/020113

PCT Pub. Date: Mar. 11, 2004

(65) Prior Publication Data

US 2005/0252835 A1 Nov. 17, 2005

(30) Foreign Application Priority Data

Aug. 26, 2002 (DE) ..... 102 39 667

(51) Int. Cl.
*B07B 1/54* (2006.01)

(52) U.S. Cl. ..... 209/382; 209/379

(58) Field of Classification Search ..... 209/379, 209/381, 382

See application file for complete search history.

(56) References Cited

U.S. PATENT DOCUMENTS

| | | | | |
|---|---|---|---|---|
| 615,524 | A * | 12/1898 | Brandstaedter | 209/310 |
| 669,586 | A * | 3/1901 | Levasseur | 209/322 |
| 3,087,617 | A | 4/1963 | Forsberg | |
| 4,122,006 | A | 10/1978 | Christensen et al. | |
| 6,422,394 | B1 * | 7/2002 | Page | 209/383 |

FOREIGN PATENT DOCUMENTS

| | | |
|---|---|---|
| DE | 296513 | 2/1917 |

* cited by examiner

*Primary Examiner*—Joseph C Rodriguez
(74) *Attorney, Agent, or Firm*—Andrew Wilford

(57) ABSTRACT

The invention relates to a sieving device provided with a sieving mat (2), which has sieving openings, and with beating elements (7), which are located underneath the sieving mat and which strike against the underside of the sieving mat (2) in order to free the sieving mat (2) from material to be sieved that is clogging the sieving openings. Said beating elements (7) are fastened to at least one elongated tensioned traction mechanism (5) such as a cable or band that extends underneath the sieving mat (2).

6 Claims, 3 Drawing Sheets

SIEVING DEVICE HAVING BEATING ELEMENTS

CROSS REFERENCE TO RELATED APPLICATIONS

This application is the US national phase of PCT application PCT/EP2003/006780, filed 26 Jun. 2003, published 11 Mar. 2004 as WO 2004/020113, and claiming the priority of German patent application 10239667.1 itself filed 26 Aug. 2002, whose entire disclosures are herewith incorporated by reference.

FIELD OF THE INVENTION

The inventions relates to a sieve with a screen having openings and beaters that are underneath the screen and that can strike the lower face of the screen in order to free the screen from material plugging the screen openings.

BACKGROUND OF THE INVENTION

German utility model 84 35 585 describes a sieve with bar-shaped beaters that are secured to an elastic mat that is mounted underneath the flexible screen. Both screens are mounted on tensioning rods that reciprocate and thus insure that the lower screen is taut and strikes with its beaters against the lower face of the upper screen in order to knock big particles out of the upper screen. The provision of a second screen underneath the first one is expensive and entails considerable extra manufacturing time.

OBJECT OF THE INVENTION

It is an object of the invention so to improve on the above-described type of sieve that, with simpler construction and assembly, the sieve openings can be reliably kept free of large and sticky particles.

SUMMARY OF THE INVENTION

This object is attained in that the beaters are mounted on an elongated longitudinally tensioned actuating element, such as a cable or belt, that extends underneath the screen.

The mounting of the beaters on elongated actuating elements is particularly simple from the manufacturing point of view and leads to particularly good results when cleaning.

Preferably the beaters are spherical. It is also suggested that the actuating element extend transversely, longitudinally, or diagonally of a movement direction of the material being sieved.

It is particularly advantageous when the screen is formed by a replaceable screen assembly that is surrounded by a downwardly projecting annular frame so that a sieve can be formed by several such screen assemblies. In this manner each removable screen assembly has its own system for clearing the screen openings of large and sticky particles.

For particularly simple assembly and installation, ends of the actuating elements are solidly releasably connected or latched to the frame of the screen.

An alternative suggestion is to provide beaters underneath a screen spanned over a full working width of a sieve, ends of the actuating elements carrying two or more beaters being fixed to side walls of the sieve. The ends of the actuating element are solidly releasably connected or latched to side walls of the sieve. It is also advantageous when transverse beams are mounted between the beaters in a lower region of the sieve and support the actuating elements.

Preferably it is suggested that the transverse beams extend transversely or longitudinally of a movement direction of the material being sieved.

It is particularly easy to exchange the beaters when the screen is releasably attached, in particular by hooking, at two opposite edges on side walls of the sieve. In the simplest construction the actuating element extends through the beaters. This also aids in changing the beaters on the actuating elements.

In an alternative attachment system a lower face of the screen is provided with projecting flat iron bars that are embedded in the plastic of the screen and that serve as attachment points for the actuating elements.

BRIEF DESCRIPTION OF THE DRAWING

Embodiments of the invention are shown in the drawing and more closely described in the following. Therein.

SPECIFIC DESCRIPTION

Figure 1:
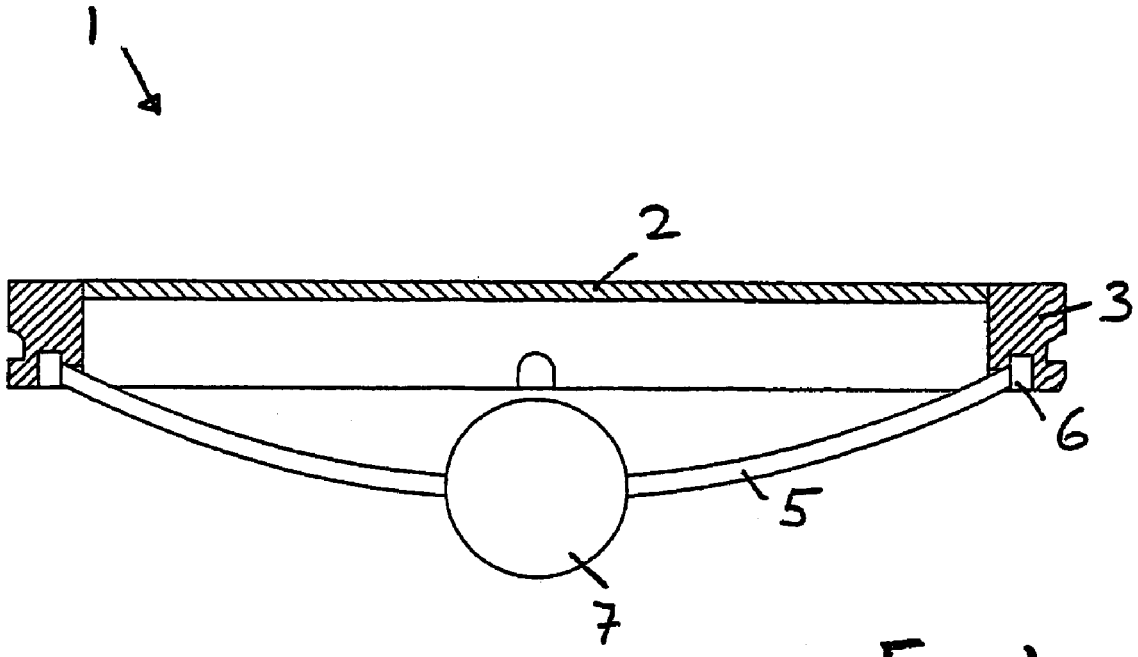
FIG. 1 is a vertical section through a single framed sieve assembly with one beater on an actuating element.
Figure 2:
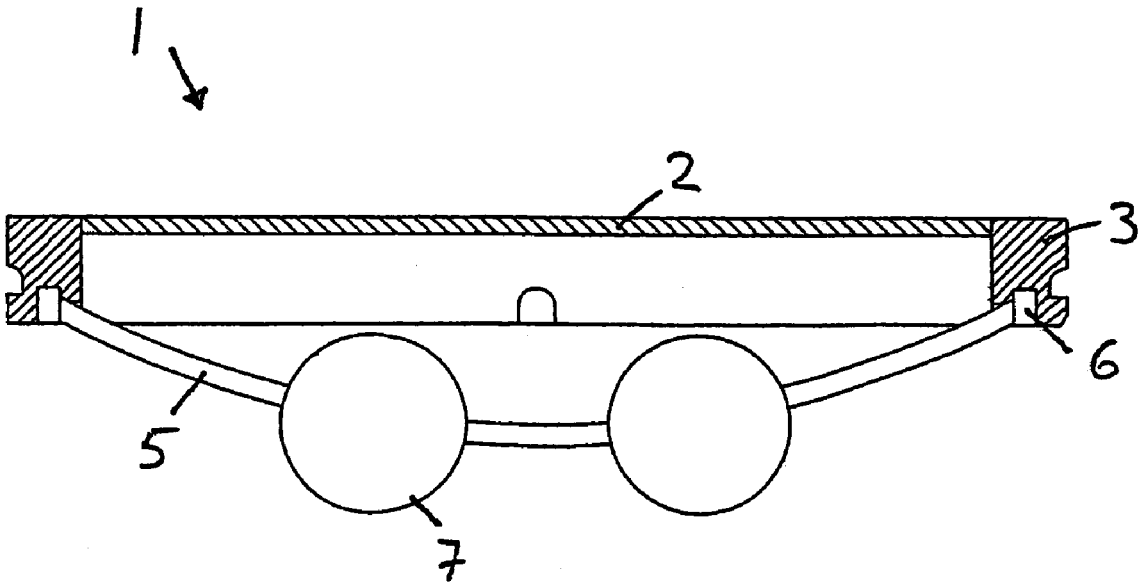
FIG. 2 is the sieve assembly according to FIG. 1 with two beaters on the actuating element.
Figure 3:
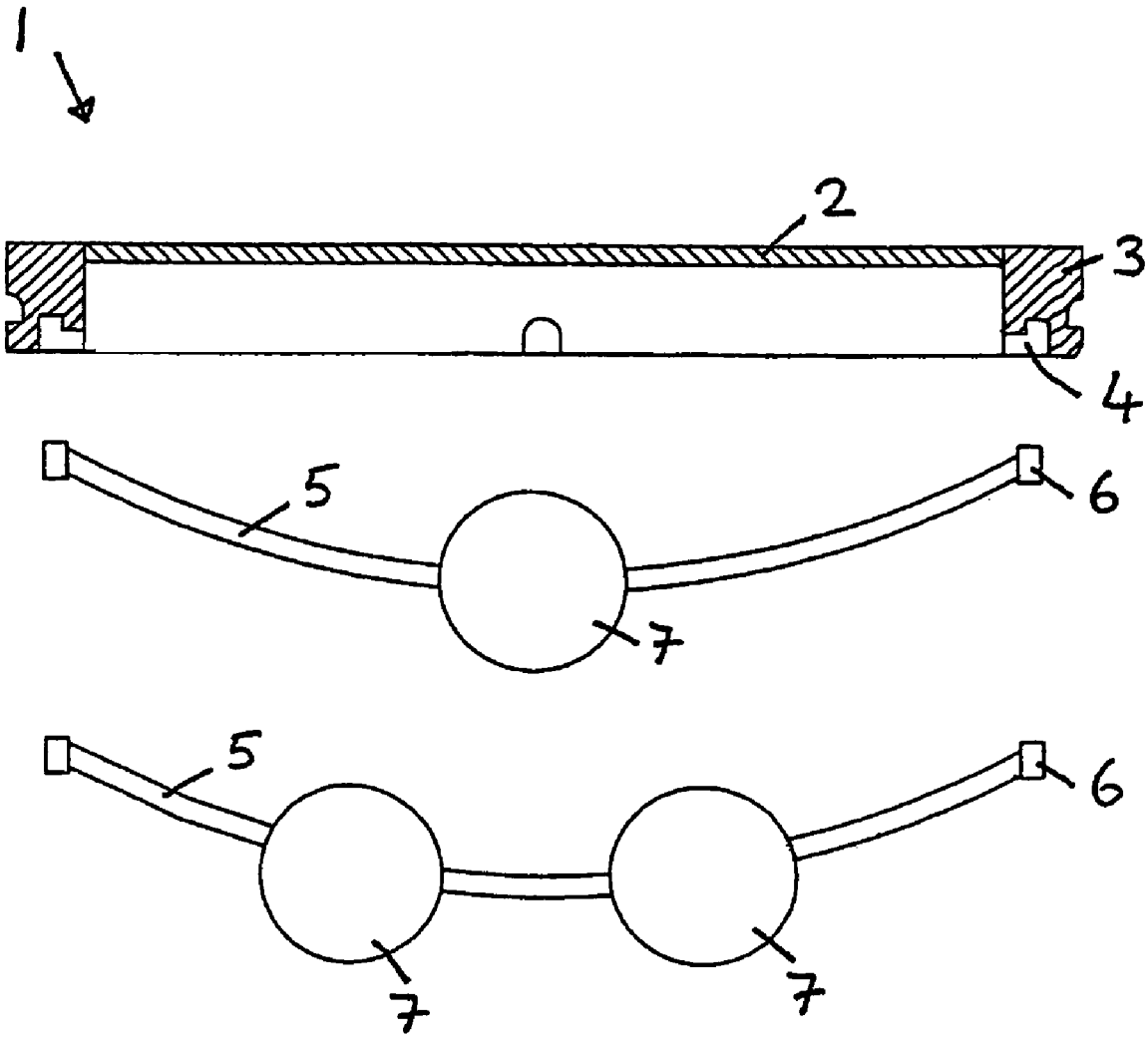
FIG. 3 is the sieve assembly according to FIG. 1 or 2 with two actuating elements with one and two beaters.

In FIGS. 1 to 3, a sieve assembly 1 is shown having a generally horizontal rectangular screen 2 in turn held in a frame having four edges with respective frame elements 3 that project downwardly past the screen 2. The screen 2 and frame elements 3 are made of plastic and secured to each other, in particular by gluing, casting, or welding, or the screen 2 and frame elements 3 are unitarily formed of plastic. The plastic is preferably polyurethane. Several such assemblies form the sieve surfaces of a sieve and are individually easily switched.

The frame elements 3 have on their lower faces a downwardly open groove or opening 4 in which ends 6 of an elongated actuating element 5 are fixed. To accomplish this the ends 6 of the elements 5 are enlarged to have the same size and shape as the openings 4 so that they fit and are held complementarily in the openings 4.

The openings 4 in the frame elements 3 can also be made with an inwardly extending projection that the end 6 is looped around so as to lock it in place.

The actuating element 5 is provided with beaters 7 that are preferably made of plastic and that can have different shapes. In all of the embodiments the beaters 7 are spherical balls.

The actuating element with its beaters can extend transversely, longitudinally, or diagonally to the movement direction of the material being sieved.

Figure 4:
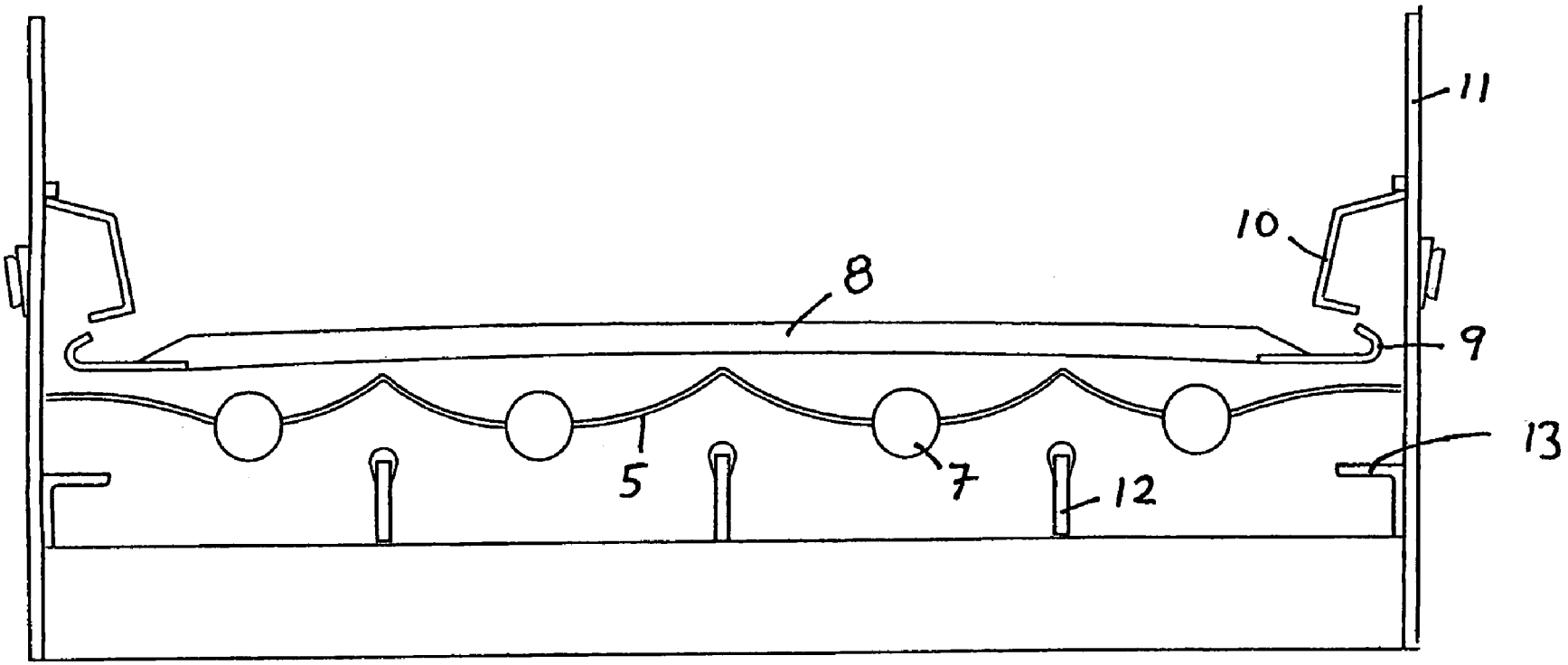
FIG. 4 is a vertical section through a sieve with a screen extending over the entire width of the sieve and underneath beaters.

The embodiment shown in FIG. 4 is a sieve with a screen 8 extending over the entire working width of the sieve and having edges provided with mounting clips 9 that are hooked on mounting rails 10 that are fixed to side walls 11 of the sieve. In this manner the screen 8 is solidly held in the sieve.

Underneath the screen 8 is an actuating element 5 whose ends are releasably mounted on the side walls 11, in particular on mounts 3 of the side walls 11. To this end the mount 13 can have a bore.

In the lower region of the sieve there are transverse beams 12 on which the actuating element 5 lies with at least one beater 7 on the element 5 between each pair of beams 12. FIG. 4 shows these elements when raised.

The beams 12 can extend transversely or longitudinally to the movement direction of the material being sieved, depending how the screen 8 is installed. With a longitudinally tensioned screen 8 the beams extend transverse to the movement direction.

In a further unillustrated embodiment flat iron bars are set on the lower face of the screen in the plastic of the screen so as to project downward and serve as mounting points for the actuating element or elements.

The invention claimed is:

1. A sieve comprising:

a support; and a plurality of identical screen assemblies removably mounted in the support and each having a generally horizontal screen, a frame surrounding the screen, connected to outer edges of the screen, and projecting downward past the screen;

an elongated and longitudinally tensioned element having opposite ends anchored in the frame at respective opposite edges thereof and extending generally horizontally underneath the screen, and a beater on the elongated element between the opposite ends thereof and underneath the screen, the beater being engageable with a lower face of the respective screen for freeing particles from openings in the screen.

2. The sieve defined in claim 1 wherein the ends of the element are removably secured in the frame.

3. The sieve defined in claim 1 wherein the beaters are balls.

4. The sieve defined in claim 1 wherein the element is a cable.

5. The sieve defined in claim 1 wherein the element is a belt.

6. The sieve defined in claim 1 wherein the frame and screen are unitarily formed of plastic.

* * * * *